US007600586B2

(12) United States Patent
Hall et al.

(10) Patent No.: US 7,600,586 B2
(45) Date of Patent: Oct. 13, 2009

(54) SYSTEM FOR STEERING A DRILL STRING

(76) Inventors: David R. Hall, 2185 S. Larsen Pkwy., Provo, UT (US) 84606; Jim Shumway, 2185 S. Larsen Pkwy., Provo, UT (US) 84606

( * ) Notice: Subject to any disclaimer, the term of this patent is extended or adjusted under 35 U.S.C. 154(b) by 553 days.

(21) Appl. No.: 11/611,310

(22) Filed: Dec. 15, 2006

(65) Prior Publication Data

US 2008/0142264 A1 Jun. 19, 2008

(51) Int. Cl.
*E21B 7/04* (2006.01)

(52) U.S. Cl. ..... 175/61; 175/73; 175/106

(58) Field of Classification Search ..... 175/61, 175/73, 101, 104, 106, 324
See application file for complete search history.

(56) References Cited

U.S. PATENT DOCUMENTS

| | | | | |
|---|---|---|---|---|
| 0,465,103 | A | 12/1891 | Wegner | |
| 0,616,118 | A | 12/1898 | Kuhne | |
| 0,946,060 | A | 1/1910 | Looker | |
| 1,116,154 | A | 11/1914 | Stowers | |
| 1,183,630 | A | 5/1916 | Bryson | |
| 1,189,560 | A | 7/1916 | Gondos | |
| 1,360,908 | A | 11/1920 | Everson | |
| 1,387,733 | A | 8/1921 | Midgett | |
| 1,460,671 | A | 7/1923 | Hebsacker | |
| 1,544,757 | A | 7/1925 | Hufford | |
| 1,821,474 | A | 9/1931 | Mercer | |
| 1,879,177 | A | 9/1932 | Gault | |
| 2,054,255 | A | 9/1936 | Howard | |
| 2,064,255 | A | 12/1936 | Garfield | |
| 2,169,223 | A | 6/1939 | Christian | |
| 2,218,130 | A | 10/1940 | Court | |
| 2,320,136 | A | 5/1943 | Kammerer | |
| 2,466,991 | A | 4/1949 | Kammerer | |
| 2,540,464 | A | 2/1951 | Stokes | |
| 2,544,036 | A | 3/1951 | Kammerer | |
| 2,755,071 | A | 7/1956 | Kammerer | |
| 2,776,819 | A | 1/1957 | Brown | |
| 2,819,043 | A | 1/1958 | Henderson | |
| 2,838,284 | A | 6/1958 | Austin | |
| 2,894,722 | A | 7/1959 | Buttolph | |
| 2,901,223 | A | 8/1959 | Scott | |
| 2,963,102 | A | 12/1960 | Smith | |
| 3,135,341 | A | 6/1964 | Ritter | |
| 3,294,186 | A | 12/1966 | Buell | |
| 3,301,339 | A | 1/1967 | Pennebaker | |
| 3,379,264 | A | 4/1968 | Cox | |
| 3,429,390 | A | 2/1969 | Bennett | |
| 3,493,165 | A | 2/1970 | Schonfield | |
| 3,583,504 | A | 6/1971 | Aalund | |
| 3,764,493 | A | 10/1973 | Rosar | |
| 3,821,993 | A | 7/1974 | Kniff | |
| 3,899,033 | A * | 8/1975 | Van Huisen | 175/97 |

(Continued)

*Primary Examiner*—Hoang Dang
(74) *Attorney, Agent, or Firm*—Tyson J. Wilde; Benjamin T. Miskin

(57) ABSTRACT

A downhole tool string component, having a first rotor secured within a bore of the component and connected to a gear assembly, the gear assembly being connected to a second rotor. The second rotor is in magnetic communication with a stator which has an electrically conductive coil, the electrically conductive coil being in communication with a load.

26 Claims, 8 Drawing Sheets

U.S. PATENT DOCUMENTS 3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 7/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Bolnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,929,076 B2 8/2005 Fanuel et al.
6,953,096 B2 10/2005 Glenhill
7,481,281 B2 * 1/2009 Schuaf ..... 175/61
7,484,576 B2 * 2/2009 Hall et al. ..... 175/73
7,497,279 B2 * 3/2009 Hall et al. ..... 175/73
7,510,031 B2 * 3/2009 Russell et al. ..... 175/170
2003/0213621 A1 11/2003 Britten
2004/0238221 A1 12/2004 Runia
2004/0256155 A1 12/2004 Kriesels

* cited by examiner

SYSTEM FOR STEERING A DRILL STRING

BACKGROUND OF THE INVENTION

This invention relates to drill bits, specifically drill bit assemblies for use in oil, gas, geothermal, and horizontal drilling. The ability to accurately adjust the direction of drilling in downhole drilling applications is desirable to direct the borehole toward specific targets. A number of steering systems have been devised for this purpose.

One such system is disclosed in U.S. Pat. No. 5,803,185, which is herein incorporated by reference for all that it contains. It discloses a steerable rotary drilling system with a bottom hole assembly which includes, in addition to the drill bit, a modulated bias unit and a control unit, the bias unit comprising a number of hydraulic actuators around the periphery of the unit, each having a movable thrust member which is hydraulically displaceable outwardly for engagement with the formation of the borehole being drilled. Each actuator may be connected, through a control valve, to a source of drilling fluid under pressure and the operation of the valve is controlled by the control unit so as to modulate the fluid pressure supplied to the actuators as the bias unit rotates. If the control valve is operated in synchronism with rotation of the bias unit the thrust members impart a lateral bias to the bias unit, and hence to the drill bit, to control the direction of drilling.

BRIEF SUMMARY OF THE INVENTION

A downhole tool string component, having a first rotor secured within a bore of the component and connected to a gear assembly, the gear assembly being connected to a second rotor. The gear assembly has a gear ratio adapted to rotate the second rotor faster than the first rotor. The second rotor is in magnetic communication with a stator which has an electrically conductive coil, the electrically conductive coil being in communication with a load. The gear assembly may be a planetary gear system.

The first rotor may be a part of a turbine or motor. The turbine may comprise a plurality of impellers intermediate a plurality of stator vanes. The second rotor may be part of an electric generator. The first rotor may be connected to a steering system.

The second rotor may comprise magnets made of samarium cobalt. The rotational speed of the second rotor may be from 1.5 to 8 times faster than the rotational speed of the first rotor. The electrically conductive coil may comprise from 1.5 to 50 windings.

The component may also comprise a hollow casing secured within the bore of the component. The component may comprise a jack element which extends from the bore into a subterranean formation. The stator may be disposed within a wall of the bore.

The load may be a resistor, nichrome wires, coiled wires, or electronics. The load may be adapted to turn on and off at a rate of at least as fast as the rotational speed of the first rotor. The load may be disposed within a wall of the bore. The load may be in communication with a downhole telemetry system. The load may be in communication with a closed-loop system.

Logic in communication with the load may be adapted to turn the load on and off. The logic may be in communication with an AC switch in communication with the load. The AC switch may be an insulated gate bipolar transistor or a triac. The logic may be in communication with a digital switch. The load may be connected to a rectifier circuit.

A sensor disposed within the component measures the orientation of the second rotor with respect to the component. A sensor secured to the component may measure the orientation of the component with respect to a subterranean formation.

DETAILED DESCRIPTION OF THE INVENTION AND THE PREFERRED EMBODIMENT

Figure 1:
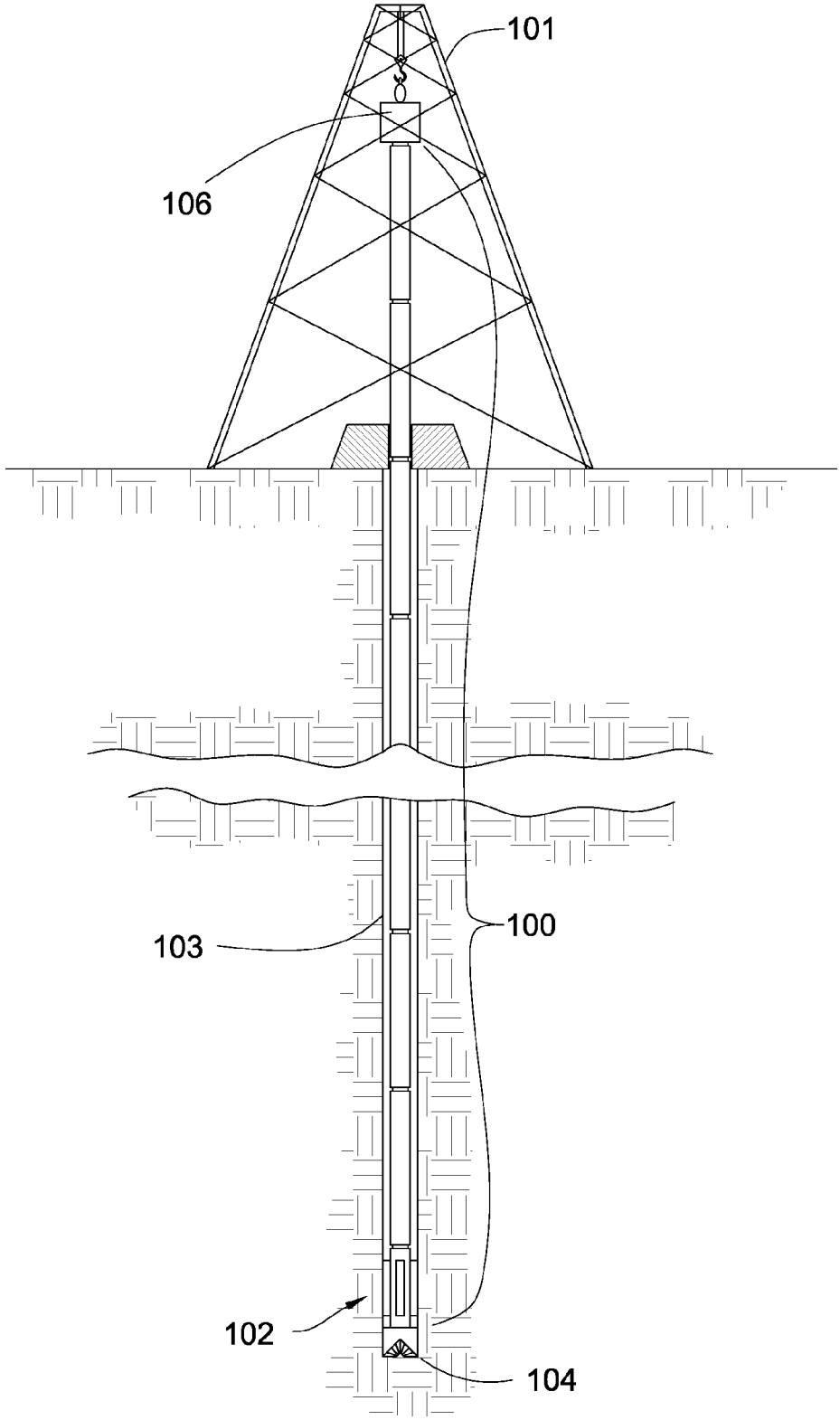
FIG. 1 is a cross-sectional diagram of an embodiment of a drill string suspended in a bore hole.

FIG. 1 is an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102.

Figure 2:
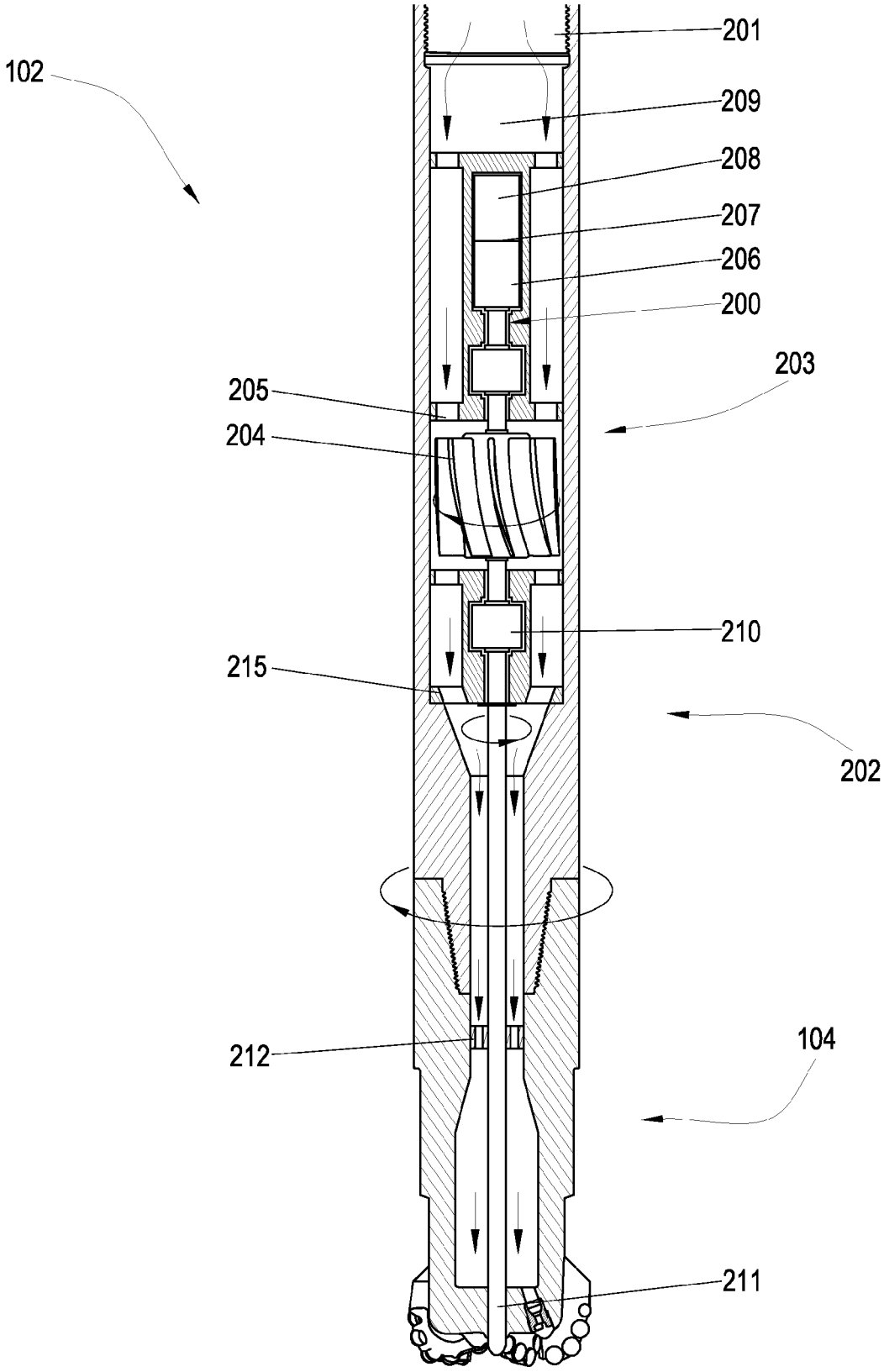
FIG. 2 is a cross-sectional diagram of an embodiment of a bottom-hole assembly.
Figure 3:
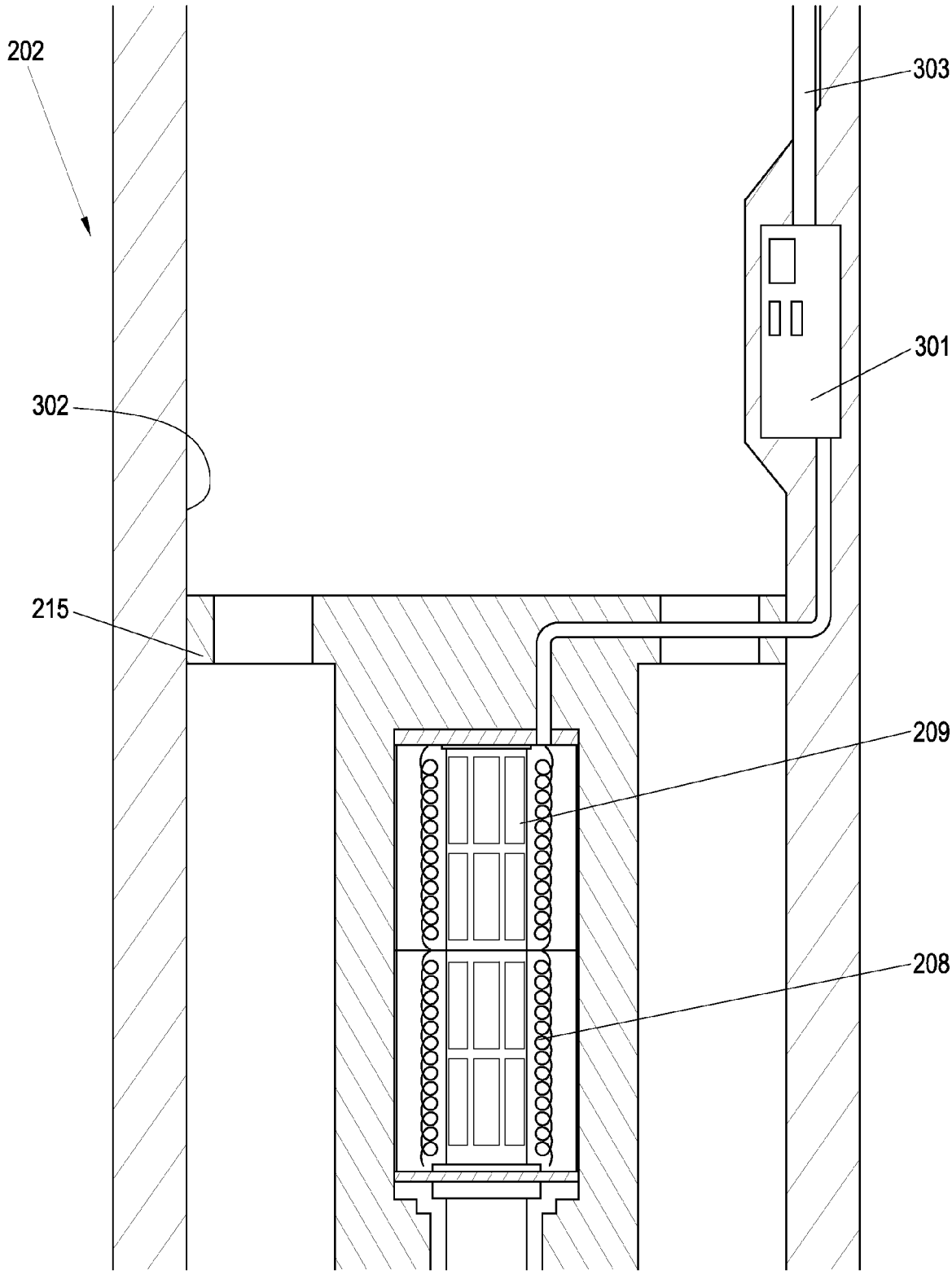
FIG. 3 is a cross-sectional diagram of an embodiment of a portion of a downhole tool string component.

Referring to FIGS. 2 and 3, the bottom-hole assembly 102 comprises a first rotor 200 disposed within a bore 201 of a tool string component 202 adjacent to a drill bit 104, which comprises a jack element 211. Preferably the jack element extends from the face of the drill bit 104 into the subterranean formation 105. In the preferred embodiment, the first rotor 200 is part of a turbine 203, though the first rotor may also be part of a motor. The turbine 203 preferably comprises from 3 to 5 impellers 204 fixed to the first rotor. A plurality of stator vanes 205 adjacent each of the impellers 204 may be rotationally fixed with respect to the bore of the component. A gear assembly connects the second rotor to the first rotor. The gear assembly 206 may be adapted to rotate the second rotor 207 faster than the first rotor 200. As drilling fluid passes through the turbine 203 in the bore, the impellers 204 rotate, spinning the gear assembly 206 and the first and second rotors. Preferably the first and second rotors will rotate at different speeds, preferably the second rotor will rotate 1.5 to 8 times faster. The stator vanes 205 in the turbine 203 may help increase the efficiency of the turbine by redirecting the flow of the drilling fluid by preventing the fluid from flowing in a circular path down the bore 201 of the drill string 100.

The second rotor 207 may be a part of an electric generator 208. The electric generator 208 also comprises a stator surrounding the second rotor 207. The stator may comprise an electrically conductive coil with 1 to 50 windings. One such generator 208 which may be used is the Astro 40 from AstroFlight, Inc. The generator 208 may comprise separate magnetic strips disposed along the outside of the rotor 207 which magnetically interact with the coil as it rotates, producing a current in the electrically conductive coil. The magnetic strips are preferably made of samarium cobalt due to its high curie temperature and high resistance to demagnetization.

The coil is in communication with a load. When the load is applied, power is drawn from the generator 208, causing the second rotor 207 to slow its rotation, which thereby slows the rotation of the turbine 203 and the first rotor. Thus the load may be applied to control the rotation of a downhole turbine. Since the second rotor rotates faster than the first rotor, it produces less torque whereby less electrical current from the load is required to slow it's rotation. Thus the gear assembly provides the advantage of reducing the electrical power requirements to control the rotation of the turbine. This is very beneficial since downhole power is a challenge to generate and store downhole.

There may also be a second generator 209 connected to the first generator 208 in order to create more current or to aid in the rotation of the first generator 208. The load may be a resistor, nichrome wires, coiled wires, electronics, or combinations thereof. The load may be applied and disconnected at a rate at least as fast as the rotational speed of the second rotor 207.

The electrical generator may be in communication with the load as part of electrical circuitry 301. The electrical circuitry 301 may be disposed within the bore wall 302 of the component 202. The generator may be connected to the electrical circuitry 301 through a coaxial cable. The circuitry may be part of a closed-loop system. The electrical circuitry 301 may also comprise sensors for monitoring various aspects of the drilling, such as the rotational speed or orientation of the component with respect to the formation. Sensors may also measure the orientation of the generator with respect to the component.

The data collected from these sensors may be used to adjust the rotational speed of the turbine in order to control the jack element 211. The jack element 211 may comprise an asymmetric tip which may be used to steer the drill bit and therefore the drill string. The control of the turbine controls the speed and orientation of the tip and therefore the drilling trajectory. In a preferred embodiment, the jack element is connected to the first rotor through another gear assembly, which may rotate the jack in the opposite direction as the turbine is rotating. Thus with the help of the controlling the turbine rotational speed, the jack element may be made to rotate with respect to the drill string while being substantially stationary with respect to a formation being drilled and allowing the jack element to steer the drill string.

The load may be in communication with a downhole telemetry system 303. One such system is the IntelliServ system disclosed in U.S. Pat. No. 6,670,880, which is herein incorporated by reference for all that it discloses. Data collected from sensors or other electrical components downhole may be sent to the surface through the telemetry system 303. The data may be analyzed at the surface in order to monitor conditions downhole. Operators at the surface may use the data to alter drilling speed if the bottom-hole assembly 102 encounters formations of varying hardness. Other types of telemetry systems may include mud pulse systems, electromagnetic wave systems, inductive systems, fiber optic systems, direct connect systems, wired pipe systems, or any combinations thereof. In some embodiments, the sensors may be part of a feed back loop which controls the logic controlling the load. In such embodiments, the drilling may be automated and electrical equipment may comprise sufficient intelligence to avoid potentially harsh drilling formations while keeping the drill string on the right trajectory. In some embodiments, drilling may be fully automated where the desired trajectory and location of the pay load is programmed into the electrical equipment and allowed to run itself without the need for manual controls.

Stabilizers 212 may be disposed around the jack element 211 and within the bore 201 of the drill bit 104 or component 202, which may prevent buckling or de-centralizing of the jack element 211.

The turbine 203, gear assemblies 206, 210, and/or generators 208, 209 may be disposed within a protective casing 215 within the bore 201 of the component 202. The casing 215 is secured to the bore wall 302 such that anything disposed within may be axially fixed with respect to the center of the bore 302. The casing 215 may comprise passages at locations where it is connected to the bore wall 302 such that the drilling fluid may be allowed to pass through.

Figure 4:
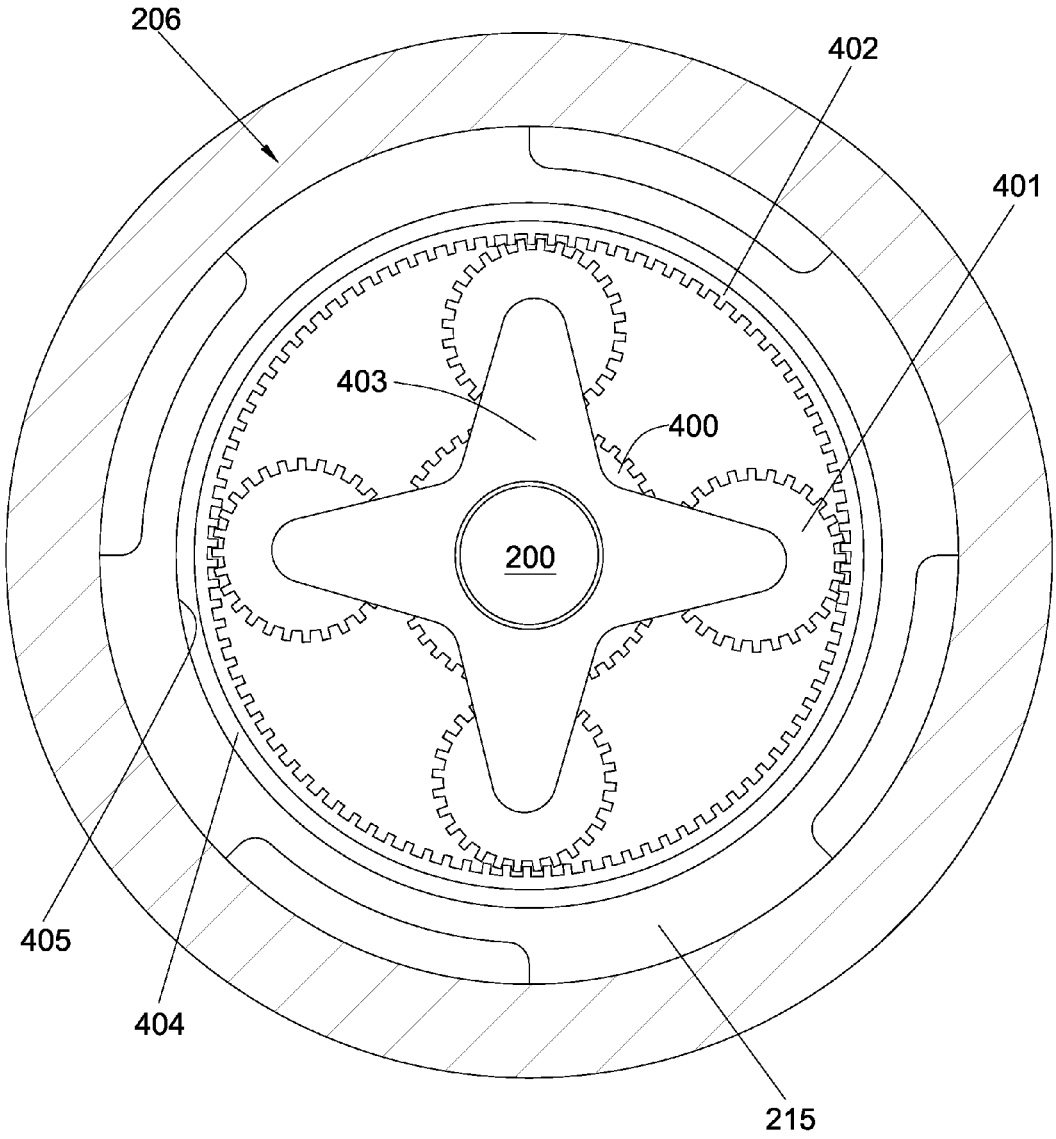
FIG. 4 is a sectional diagram of an embodiment of a gear assembly in a downhole tool string component.

The gear assembly 206 in the embodiment of FIG. 4 is a planetary gear system which may be used to connect the jack element to the first rotor. The planetary gear system comprises a central gear 400 which is turned by the first rotor connected to the turbine 203. As the central gear 400 rotates, a plurality of peripheral gears 401 surrounding and interlocking the central gear 400 rotate, which in turn cause an outer gear ring 402 to rotate. The rotational speed ratio from the central gear 400 to the outer gear ring 402 depends on the sizes of the central gear and the plurality of peripheral gears 401. The gear assembly 206 also comprises a support member 403 for the purpose of maintaining the peripheral gears 401 axially stationary.

The planetary gear system is disposed within the casing 215 such that there is a gap 404 between the outer gear ring 402 and the casing 215 so that the gear ring 402 may rotate. The casing 215 may also comprise an inner bearing surface 405 such that the gear assembly 206 and the casing 215 may be flush with the gear ring 402 may still rotate. The casing 215 may also comprise a plurality of passages 406 wherein drilling fluid may pass through the bore 201 of the component 202.

Figure 5:
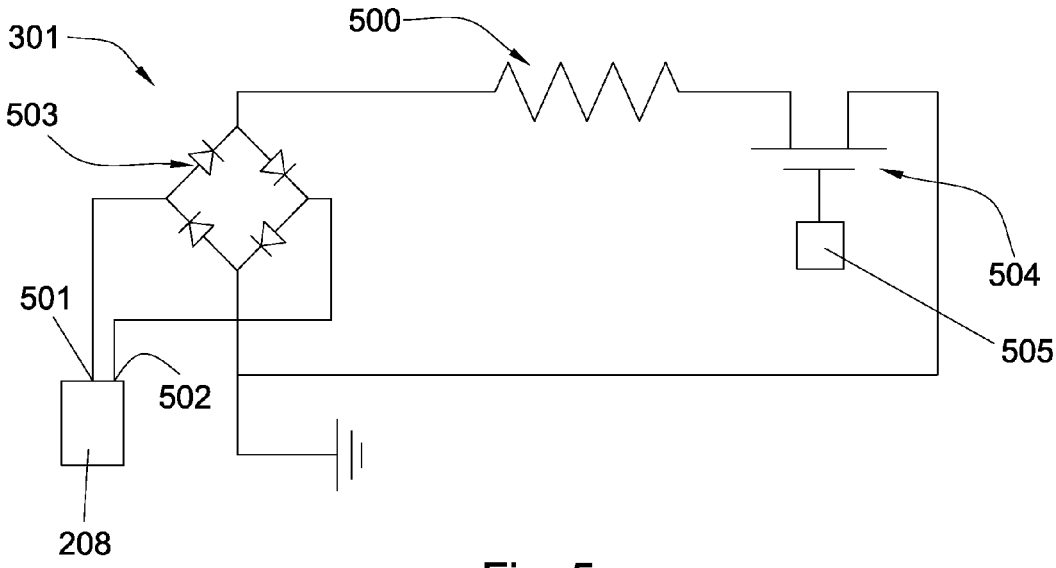
FIG. 5 is a schematic diagram of an embodiment of a generator in communication with a load.

In the embodiment of FIG. 5, the load 500 is a resistor in an electrical circuit 301 which is electrically connected to the generator 208. The rotation of the generator 208 produces an AC voltage across the two generator terminals 501, 502. The circuit comprises a bridge rectifier 503, which converts the AC voltage into a DC voltage. The circuit also comprises a DC switch 504, such as a field-effect transistor (FET), which is driven by logic instructions 505 that turn it on or off. When the DC switch 504 is on, the circuit is completed, causing the DC voltage to drop across the load 500 and drawing power from the generator 208, which thereby causes the rotational speed of the generator 208 to slow. When the DC switch 504 is off, however, the circuit is an open circuit and no power is drawn from the generator 208. A FET switch may be a low cost option for completing the circuit, though it requires DC currents to operate.

Figure 6:
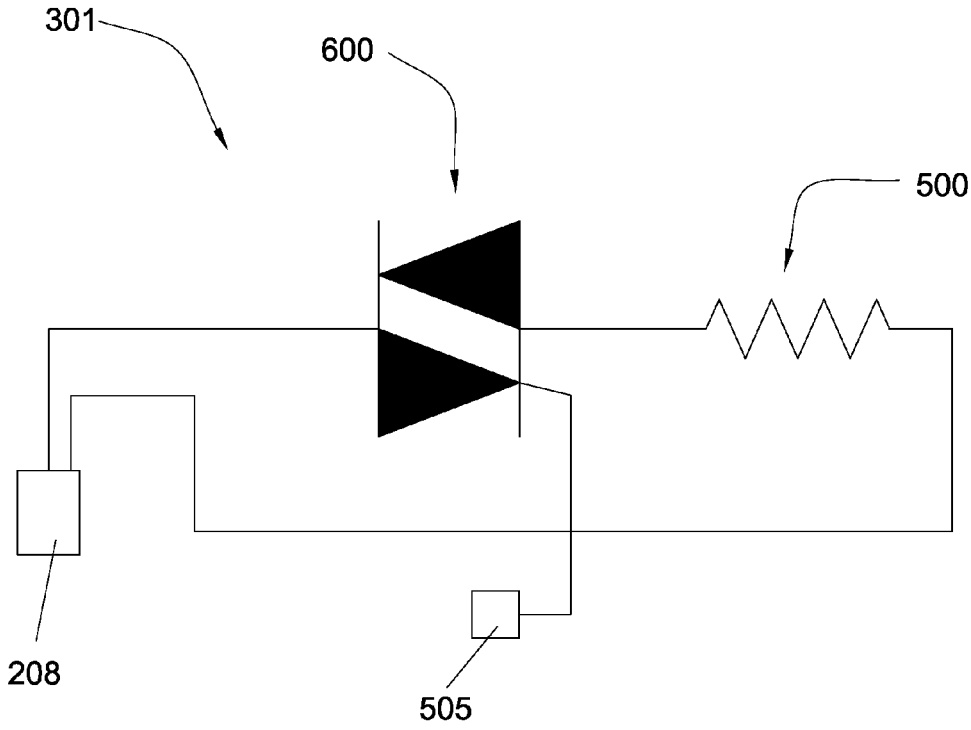
FIG. 6 is a schematic diagram of another embodiment of a generator in communication with a load.

FIG. 6 shows another embodiment of a circuit comprising an AC switch 600. The AC switch 600 may be a triode for alternating current (triac), which allows the load to be turned on or off with AC current. The triac may switch whenever the AC voltage crosses zero, which may happen at half cycles of the generator output, depending on the logic instructions 505 driving the switch. An AC switch 600 alternative to the triac is an insulated gate bipolar transistor (IGBT). An advantage to using an IGBT is that the IGBT is able to switch on and off at a rate independent of the cycle period or zero crossing of the AC voltage from the generator 208, though the IGBT is more expensive and complex than the triac.

Figure 7:
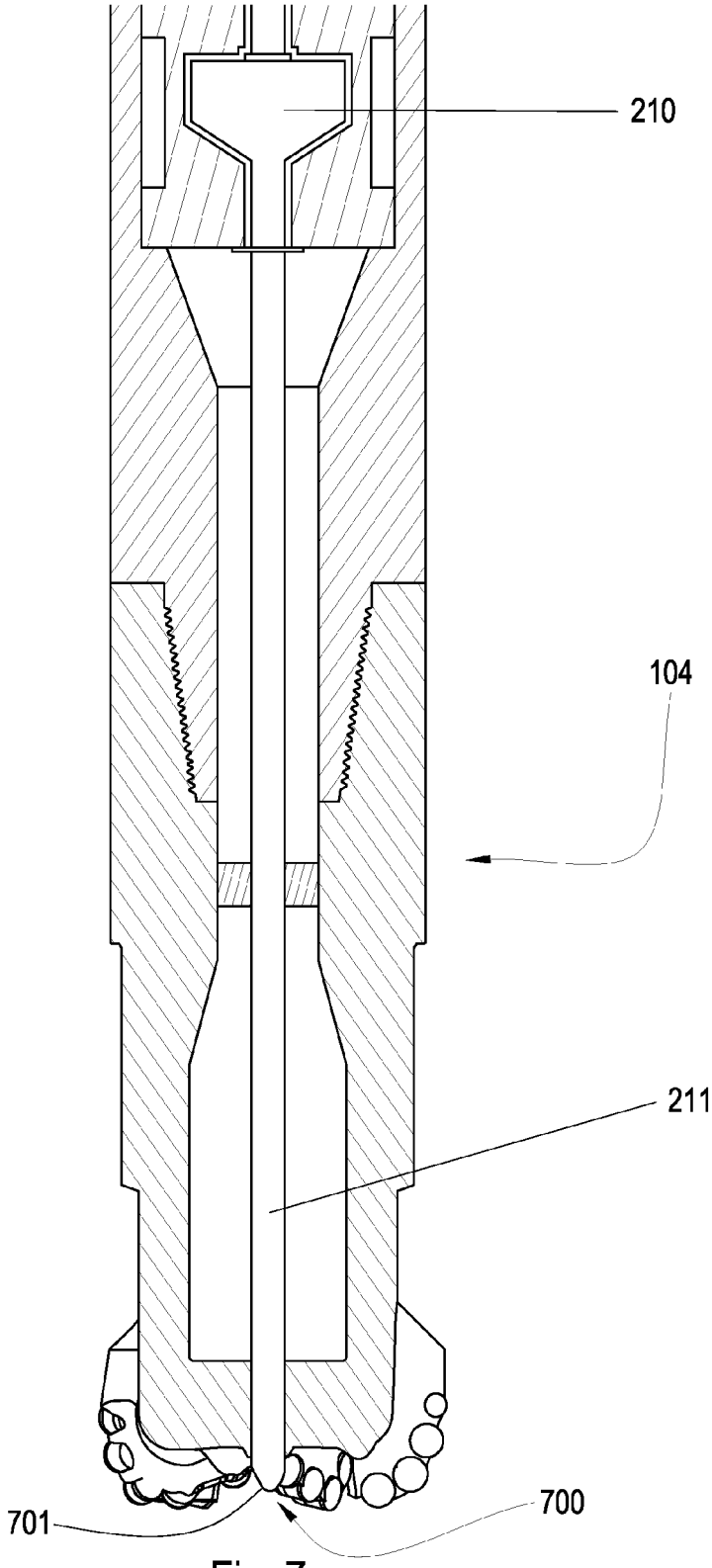
FIG. 7 is a cross-sectional diagram of an embodiment of a steering mechanism in a bottom hole assembly.

Referring to FIG. 7, the jack element 211 is adapted such that it may be used as a steering system for the drill string 100.

The jack element 211 may comprise an asymmetric tip 700 such that one side 701 has more surface area exposed to the formation. The gear assembly 210 is adapted such that the rotational speed of the turbine 203 is from 10 to 25 times faster than the rotational speed of the jack element 211. As the drill string rotates, the turbine 203 may rotate such that the jack element 211 remains rotationally stationary with respect to the formation. When the jack element 211 is engaged against the formation and is rotationally stationary with respect to the formation, it is believed that the asymmetry of the tip will deviate the direction of the drill string. The orientation of the tip may be adjusted by the logic which is in communication with the load. The sensors may indicate the position of the tip and through a feed back loop the logic may adjust the load to reoriented the tip. With such a method, the complex drilling trajectories are possible. By causing the jack element to rotate with the drill bit, it is believed to cause the drill string to drill in a generally straight direction.

Figure 8:
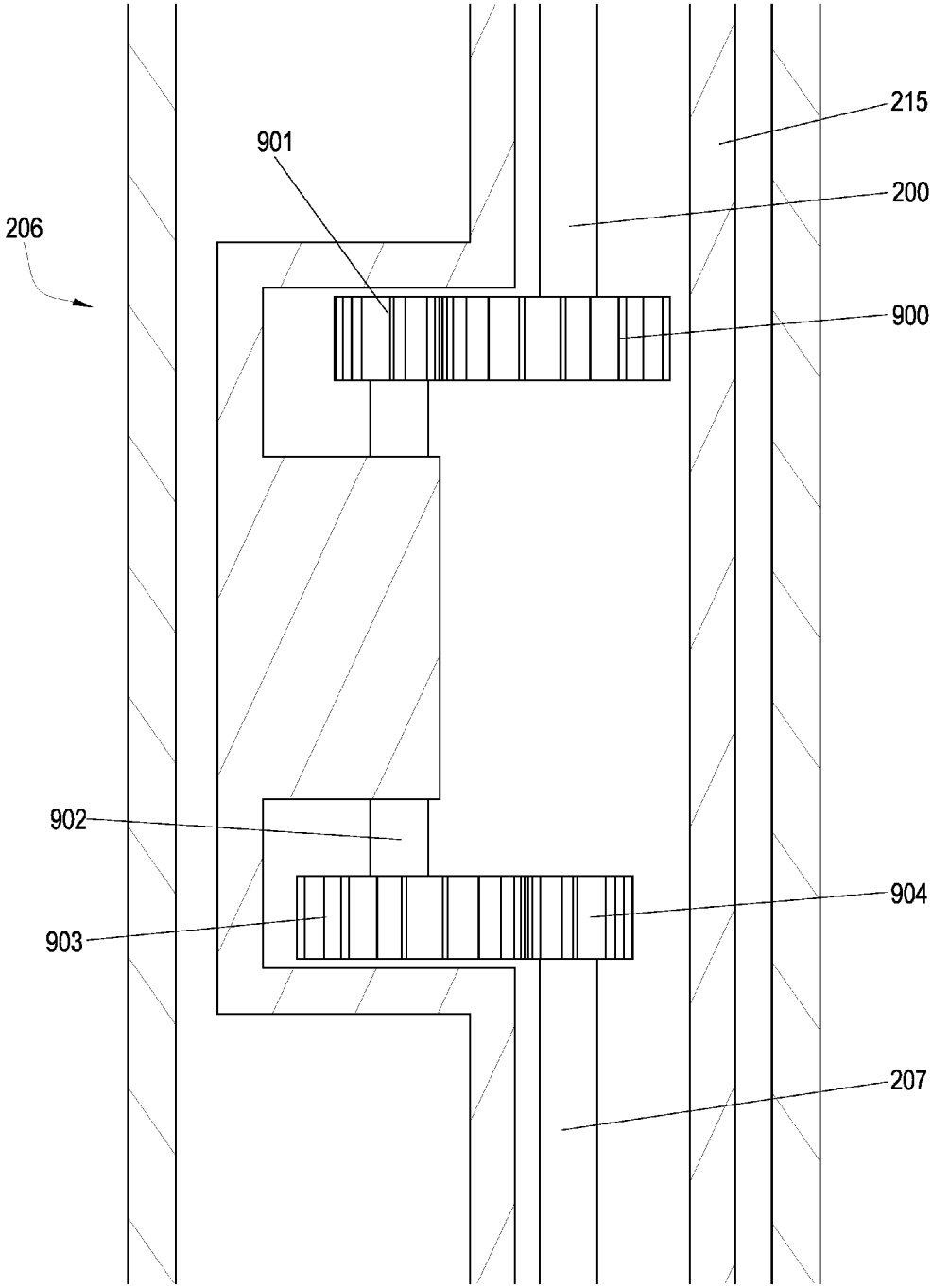
FIG. 8 is a sectional diagram of another embodiment of a gear assembly in a downhole tool string component.
Figure 9:
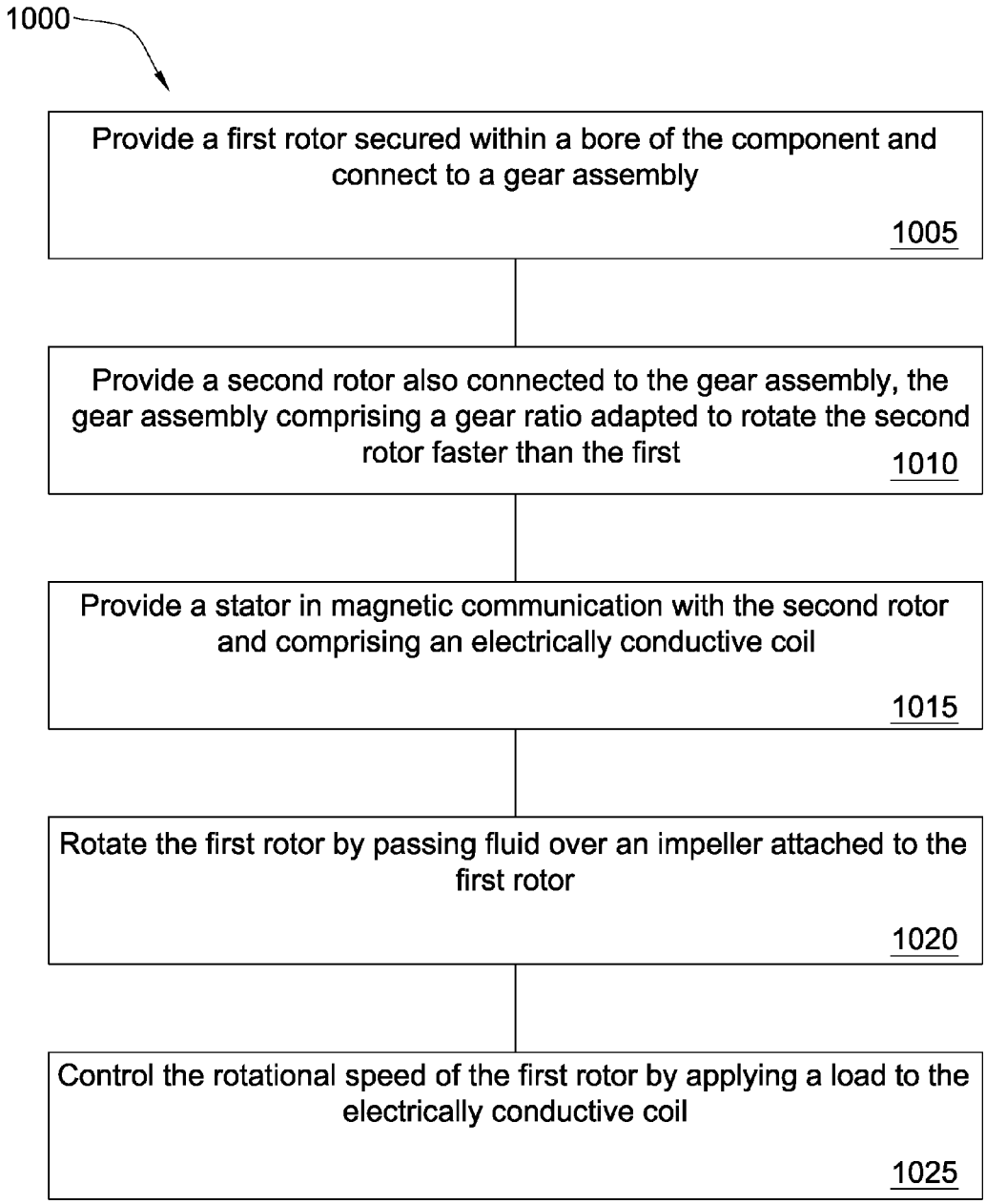
FIG. 9 is a diagram of a method for controlling the rotational speed of a rotor in a downhole component.

Referring to FIG. 8, the gear assembly 206 may comprise spur gears. A first spur gear 900 may be attached to the first rotor 200 and be in communication with a second spur gear 901. The second spur 901 gear may be attached to an intermediate shaft 902 supported by the casing 215. The second shaft 902 may also comprise a third gear 903 which is in communication with a fourth gear 904 attached to the second rotor 207. The sizes of the gears are adapted such that the second rotor 207 rotates faster than the first rotor 200. The casing 215 and/or the intermediate shaft 902 may comprise bearing surfaces 905 to reduce friction where the casing 215 supports the intermediate shaft 905. Referring to FIG. 9, a method 1000 for controlling the rotational speed of a rotor in a downhole component comprises the steps of providing 1005 a first rotor secured within a bore of the component and connected to a gear assembly; providing 1010 a second rotor also connected to the gear assembly, the gear assembly comprising a gear ratio adapted to rotate the second rotor faster than the first rotor; providing 1015 a stator in magnetic communication with the second rotor and comprising an electrically conductive coil; rotating 1020 the first rotor by passing fluid over an impeller attached to the first rotor; and controlling 1025 the rotational speed of the first rotor by applying a load to the electrically conductive coil.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a first rotor secured within a bore of the component and connected to a gear assembly;

the gear assembly being connected to a second rotor;

the gear assembly comprising a gear ratio adapted to rotate the second rotor faster than the first rotor;

the second rotor being in magnetic communication with a stator which comprises an electrically conductive coil; and the electrically conductive coil being in communication with a load.

2. The component of claim 1, wherein the first rotor is a part of a turbine or motor.

3. The component of claim 1, wherein the first rotor is connected to a steering system.

4. The component of claim 3, wherein the steering system comprises a jack element which extends from the bore into a subterranean formation.

5. The component of claim 4, wherein the jack element is attached to the first rotor through a second gear assembly.

6. The component of claim 5, wherein the jack element rotates opposite of the first rotor.

7. The component of claim 3, wherein the jack element comprises an asymmetric distal end adapted to contact the subterranean formation.

8. The component of claim 1, wherein the second rotor is part of an electric generator.

9. The component of claim 1, wherein the second rotor comprises magnets made of samarium cobalt.

10. The component of claim 1, wherein the electrically conductive coil comprises from 1.5 to 10 windings.

11. The component of claim 1, wherein the gear assembly is a planetary gear system.

12. The component of claim 1, wherein the rotational speed of the second rotor is from 1.5 to 8 times faster than the rotational speed of the first rotor.

13. The component of claim 1, wherein logic in communication with the load is adapted to turn the load on and off.

14. The component of claim 13, wherein the logic is in communication with an AC switch in communication with the load.

15. The component of claim 14, wherein the AC switch is an insulated gate bipolar transistor or a triac.

16. The component of claim 13, wherein the logic is in communication with a DC switch.

17. The component of claim 1, wherein the load is connected to a rectifier circuit.

18. The component of claim 1, wherein the load is in communication with a downhole telemetry system.

19. The component of claim 1, wherein the load is a resistor, nichrome wires, coiled wires, electronics, or combinations thereof.

20. The component of claim 1, wherein the load is adapted to turn on and off at a rate at least as fast as the rotational speed of the second rotor.

21. The component of claim 1, wherein the component comprises a jack element which extends from the bore into a subterranean formation.

22. The component of claim 21, wherein the jack element is attached to the first rotor through a second gear assembly.

23. The component of claim 22, wherein the jack element rotates opposite of the first rotor.

24. The component of claim 1, wherein a sensor disposed within the component measures the orientation of the second rotor with respect to the component.

25. The component of claim 1, wherein a sensor secured to the component measures the orientation of the component with respect to a subterranean formation.

26. A method for controlling the rotational speed of a rotor in a downhole component, comprising:

providing a first rotor secured within a bore of the component and connected to a gear assembly;

providing a second rotor also connected to the gear assembly, the gear assembly comprising a gear ratio adapted to rotate the second rotor faster than the first rotor;

providing a stator in magnetic communication with the second rotor and comprising an electrically conductive coil;

rotating the first rotor by passing fluid over an impeller attached to the first rotor; and controlling the rotational speed of the first rotor by applying a load to the electrically conductive coil.

* * * * *